United States Patent [19]

Geisser

[11] 4,324,029

[45] Apr. 13, 1982

[54] APPARATUS FOR RETRACTING FLATS FROM THE CAST IRON FLAT BARS OF CARDING MACHINES

[75] Inventor: Stephan Geisser, Oberriet, Switzerland

[73] Assignee: Graf & Cie. A.-G., Rapperswil, Switzerland

[21] Appl. No.: 102,448

[22] Filed: Dec. 11, 1979

[30] Foreign Application Priority Data

Aug. 14, 1979 [CH] Switzerland ..... 7436/79

[51] Int. Cl.[3] ..... B23P 19/04

[52] U.S. Cl. ..... 29/239; 29/253; 144/193 R

[58] Field of Search ..... 29/253, 239; 254/104; 144/193 R, 114 R, 121; 83/870; 156/584

[56] References Cited

U.S. PATENT DOCUMENTS

| | | | |
|---|---|---|---|
| 1,243,404 | 10/1917 | Harris | 144/121 |
| 1,800,384 | 4/1931 | Haack | 29/239 X |
| 2,105,215 | 1/1938 | Dinzl | 144/193 R |
| 3,407,855 | 10/1968 | Ritchie | 144/193 R |
| 4,103,724 | 8/1978 | Braid | 254/104 X |
| 4,223,707 | 9/1980 | Jensen et al. | 144/193 R |

*Primary Examiner*—Robert C. Watson

*Attorney, Agent, or Firm*—Lane, Aitken, Kice & Kananen

[57] ABSTRACT

An apparatus for the retraction of worn flats from the cast iron flat bars of a carding machine. A retracting wedge is mounted on a spindle nut which is threadingly mounted on a threaded spindle and movable longitudinally thereof. The apparatus is provided further with supports and clamping devices for a flat bar, which supports and clamping device are arranged such that the flat bar mounted thereon extends parallel to mentioned spindle. Upon rotating the spindle the retracting wedge moves longitudinally along the flat bar whereby its knife edges separate the worn flat from the flat bar. The retracting wedge is operable in both longitudinal directions of the threaded spindle.

8 Claims, 7 Drawing Figures

APPARATUS FOR RETRACTING FLATS FROM THE CAST IRON FLAT BARS OF CARDING MACHINES

BACKGROUND OF THE INVENTION

1. Field of the Invention

The present invention relates to the retracting of flats from the flat bars of carding machines and specifically to an apparatus for retracting the flats from the flat bars of a carding machine.

2. Description of the Prior Art

Old, worn or damaged flats of carding machines have customarily been manually removed or retracted, respectively, from their respective cast iron flat bars. To this end use has been made of pliers, custom made or special, respectively, tools by means of which the metal clamps holding the flats and their respective bars have been detached and the flats pushed or pulled, respectively, off their respective flat bars. Such procedure involves however the risk of accidents and is time and energy consuming. Further, it has been attempted to retract the flats by aid of special tools including hooks and wedges. In addition to above mentioned risks of accident and excessive time consumption latter attempt has led often-times to damaging, breaking and destructing of the cast iron flat bars.

SUMMARY OF THE INVENTION

Hence, it is a general object of the present invention to provide an apparatus for retracting flats from flat bars of a carding machine which does not give rise to accidents and breakage of the flat bars and which allows the flats to be retracted within a significally shorter time.

A further object is to provide an apparatus comprising a supporting means for flat bars and a flat retracting wedge means operable longitudinally of said supporting means for an automatic severing of said flats from said flat bars.

Another object is the provision of an apparatus comprising a flat retracting wedge by means of which the flat and its metal clamps can be removed automatically and cleanly from the flat bar in one operating step, without damaging the flat bar. According to a preferred embodiment the retracting wedge is alternatively operable in opposite directions of the flat bar and is provided with knife edges whereby a knife edge each faces in either of said directions.

Preferably the retracting wedge is mounted to a spindle nut which is arranged on a motor driven screw spindle and is guided axially displaceable and non-rotatable thereon. However, any other suitable kind of translatory drive for such retracting wedge can be utilized, such as e.g. a driven feed chain arrangement into which the retracting wedge is coupled.

BRIEF DESCRIPTION OF THE DRAWINGS

The present invention will be more fully understood by reference to the following detailed description thereof, when read in conjunction with the attached drawings, wherein.

DETAILED DESCRIPTION OF THE PREFERRED EMBODIMENT

Figure 1:
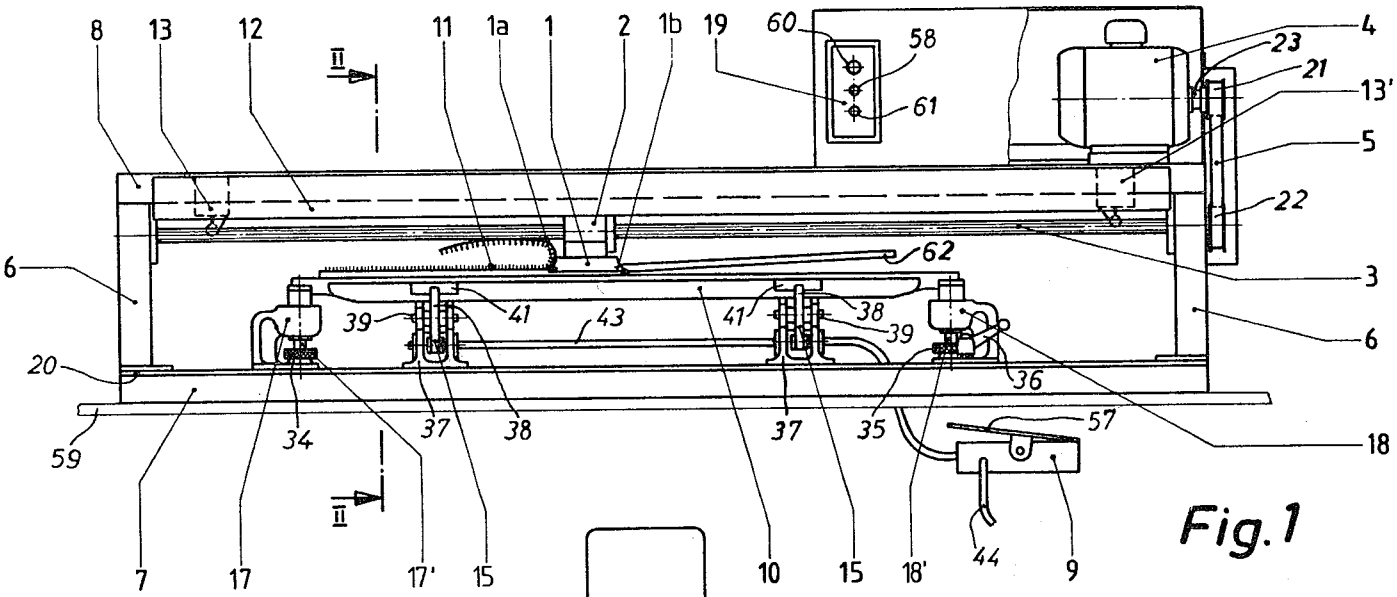
FIG. 1 is a side view of an embodiment of the apparatus for retracting flats constructed according to the present invention.
Figure 2:
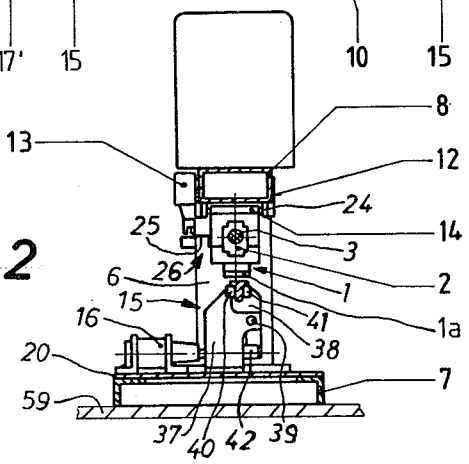
FIG. 2 is a view of a section of the apparatus shown in FIG. 1 along line II—II thereof.

Describing now the drawings, and considering initially the exemplary embodiment shown in FIGS. 1 and 2, it will be understood that the same comprises a base plate 59 which supports a base frame 7 made of L-shaped profile irons. The base frame 7 is covered by a steel plate 20 which is welded thereto. This steel plate 20 carries at both its ends an upright supporting column 6. These columns 6 support a horizontal hollow beam 8 with a rectangular square section. This hollow beam 8 carries in turn on both its sides an upright standing guide plate 12, the beam 8 and plates 12 defining a guideway. The supporting columns 6 support, furthermore, a screw spindle 3 which is driven by a motor 4 by means of a toothed belt 5 engaging on one side a sprocket 21 mounted to the driving shaft 23 of motor 4 and engaging on the other side a sprocket 22 coupled rigidly to screw spindle 3. The screw spindle 3 engages threadingly a spindle nut 2. This spindle nut 2 is rigidly connected to a carriage 14. (See FIG. 2.) Carriage 14 is provided with rollers 24 which are supported and guided in the guide plates 12. Accordingly, carriage 14 is movable longitudinally of and supported by the hollow beam 8 and guided therealong by the guide plates 12.

Mentioned spindle nut 2 carries a retracting wedge 1 which will be described more in detail further below. The beam 8 carries, furthermore, two limit switches 13,13' limiting the extent of travel of the spindle nut 2 along the spindle 3. The limit switches 13,13' are operated by a plate 25 defined by one leg of an angle piece 26 secured to the spindle nut 2. Due to the guidance provided by the beam 8 with a square cross-section and by the guide plates 12 a lateral displacement of the retracting wedge 1 is positively prevented.

Figure 4:
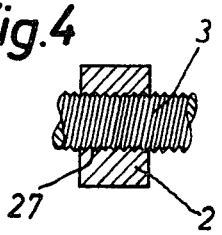
FIG. 4 is a diagrammatic section through a spindle nut and a spindle in form of a worm gear in accordance with a second embodiment of the present invention.

In the embodiment shown in FIG. 1, of which a detail is shown in FIG. 4, the screw spindle 3 is a threaded spindle meshing with the accordingly designed spindle nut 2 having an inner thread 27.

Figure 3:
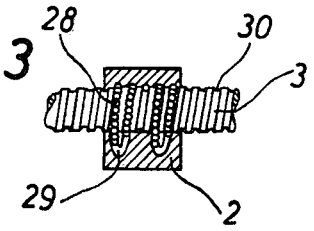
FIG. 3 is a diagrammatic section through a spindle nut and a ball spindle in accordance with a first embodiment of the present invention.

According to a further embodiment, see FIG. 3, the spindle nut 2 is provided with bearing balls 28 arranged in an endless channel 29 formed therein, whereby the screw spindle 3 is provided with a recess 30 extending in a screwlike fashion therealong. This arrangement reduces the friction forces between spindle nut 2 and spindle 3.

Figure 5:
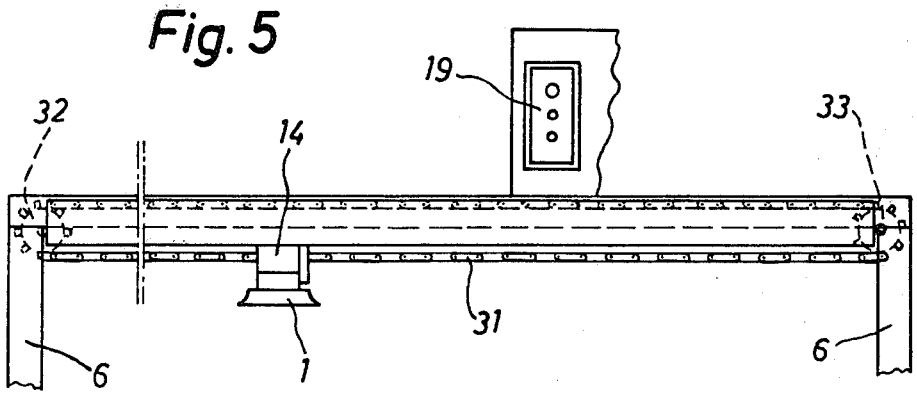
FIG. 5 is a simplified side view, similar to FIG. 1, of a further embodiment of the present invention.

In accordance with a further embodiment a feed chain arrangement for the carriage 14 is provided in place of the spindle nut 2 and spindle 3, such as shown in FIG. 5. Thereby, carriage 14 is mounted to an endless chain 31 supported and guided at one end by an idler sprocket 32 and at the other end by a driving sprocket 33, (corresponding operationally to sprocket 22 of FIG.

1), which in turn is driven from motor 4 by conventional means.

Attention is now drawn again to FIG. 1. The base frame 7 supports two supporting pedestals 17, 18 for the flat bar 10. In order to allow the handling of flat bars 10 of various design the supporting height of the two pedestals 17, 18 is adjustable. To this end the pedestals 17,18 are provided with elevating screws 17',18'. These elevating screws 17',18' can be operated by knurled nuts 34,35. By rotating the knurled nuts 34,35 the supporting height of the pedestals 17,18 can be altered individually.

Furthermore, the supporting pedestal 18 shown at the right side of base frame 7 is adjustable in a direction parallel to the threaded spindle 3, such to accommodate flat bars of various lengths. Accordingly, the base frame 7 is provided with two grooves extending parallel to the spindle 3 and supporting pedestal 18 comprises corresponding mounting elements. This construction is well known in the art and thus not particularly shown. In FIG. 1 there is shown however a locking lever arm 36 with which pedestal 18 is to be locked or unlocked, respectively, in mentioned grooves.

The two supporting pedestals 17,18 are intended solely for supporting a flat bar 10. Such flat bar 10 is held or locked, respectively, in place by means of two pneumatically operated clamping devices 15, such as shown in FIG. 1 and 2.

These clamping devices comprise a fixed clamping member 37 rigidly connected to the base frame 7. A movable clamping member 38 is pivotally mounted to the fixed clamping member 37 by the agency of a pivot pin 39. The upper flat engaging end of the fixed clamping member 37 carries a flat engaging bar 40 and corresponding movable clamping member 38 carries a corresponding flat engaging bar 41, the bars 40,41 being constructed from a relatively soft material to avoid damaging of the flat bar clamped therebetween.

The lower end of the movable clamping member 38 is hingedly connected to the piston rod 42 of a compressed air cylinder 16. The compressed air cylinder 16 of either clamping device 15 communicates by means of an air hose 43 (see FIG. 1) with a control- or actuation valve 9, respectively, which may be operated by the hand or the foot of an operating person. The control valve 9 communicates by means of a pressurized air supply hose 44 to a source of pressurized air (not shown).

Figure 6:
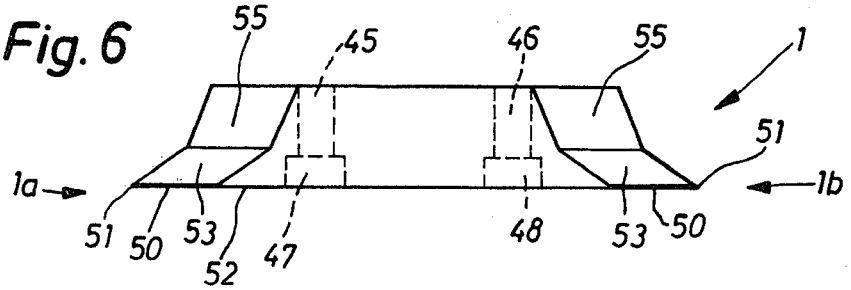
FIG. 6 is a side view of a flat retracting wedge according to an embodiment of the present invention.
Figure 7:
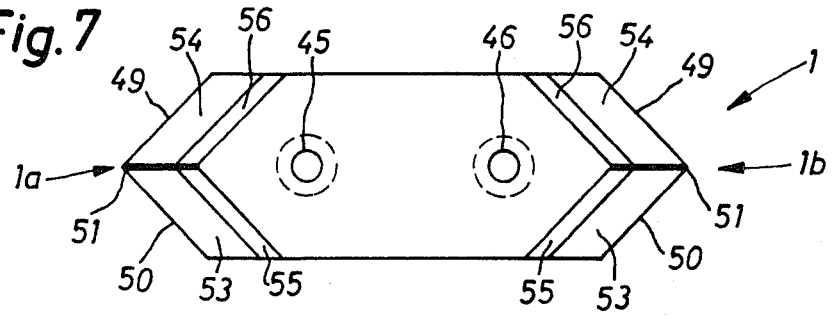
FIG. 7 is a top view of the flat retracting wedge shown in FIG. 6.

An embodiment of the retracting wedge 1 is shown in FIGS. 6 and 7. This wedge is a massive body having two through holes 45,46 with a recess 47,48 for receiving a hollow screw with head by the agency of which the wedge 1 is mounted to the bottom side of carriage 14.

The wedge 1 features seen in plan view a hexagonal shape including a front knife or separating edge **1*a* and a rear knife or separating edge 1*b*. As shown, each knife edge 1*a*, 1*b* is provided with two knife edge sections 49,50 extending at an angle relative to each other thus forming together a tip 51. According to FIG. 6 and 7 the knife edges 1*a*, 1*b* are defined by the bottom surface of wedge 1 and first slanted wedge surfaces 53,54. These first wedge surfaces 53,54 are followed by stronger sloping guide surfaces 55,56 for guiding the severed flat 11 (FIG. 1) upon its detachment from the flat bar 10 as will be explained further below. Thus, the wedge 1 is not only intended for severing the flat 11 from the flat bar 10** but also for guiding the detached parts to avoid any entanglements.

The operation of the flat retracting apparatus is as follows. Firstly, the supporting height for the respective flats to be handled is adjusted by means of operating the knurled nuts 34 of the flat supporting pedestals 17,18. Thereafter the distance between the flat supporting pedestals 17,18 is adjusted in accordance with the length of the flats to be handled in that locking lever arm 36 of pedestal 18 is operated and pedestal 18 adjusted longitudinally of the flat retracting apparatus. Thereafter pedestal 18 is locked in place by operating locking lever arm 36.

It shall be assumed that the retracting wedge 1 is in its right side end position, i.e. adjacent the limit switch 13' mounted below motor 4.

By depressing the operating lever 57 of the control valve 9 the compressed air cylinders 16 are put in operation such that the movable clamping member 38 pivots around pivot pin 39. Accordingly, the clamping bar 41 of the movable clamping member 38 moves away from the clamping bar 40 of the fixed clamping member 37. The flat bar 10, from which the flat 11 is to be removed, can now be inserted therebetween and upon release of the operating lever 57 of the control valve 9 the flat bar 10 is firmly gripped by and held in the clamping devices 15. Thereafter the "ON" button 58 of the control panel 19 is pushed. (61 designates the "OFF" button and 60 designates the emergency stop button.) Accordingly, motor 4 is set in motion and begins to drive spindle 3 (or chain 31 of the embodiment of FIG. 5). Wedge 1 begins to move to the left.

Because the position, i.e. the height of the upper surface of the flat bar 10 has been exactly adjusted by the supporting pedestals 17,18 the vertical clearance between the bottom surface 52 of the retracting wedge 1 and the upper surface of the flat bar 10 is extremely small such that the leading tip 51 of the wedge 1 will penetrate between the upper surface of the flat bar 10 and the flat 11 proper and a lifting off of the center area of the flat 11 will be initiated. Immediately thereafter the leading knife edge sections 49,50 penetrating obviously also between the flat bar 10 and the flat 11 engage the two metal clamping webs 62 with which the flat 11 is clamped to the clamp bar 10 and pry the two clamping webs 62 laterally away from the flat bar 10 and flat 11.

The flexible flat 11 thus severed from the flat bar 10 is guided by the leading first wedge surfaces 53,54 and thereafter by the leading guide surfaces 55,56 of the retracting wedge 1 such that it is looped back on itself in a manner shown in FIG. 1.

The retracting wedge 1 keeps on moving to the left until the flat 11 and the clamp 62 are completely severed from the flat bar 10 whereby no manual work must be performed and until it strikes the limit switch 13 thus stopping motor 4.

Whilst the retracting wedge 1 remains in its left side end position the flat bar 10 freed of its flat 11 is removed from the apparatus by pneumatically operating the clamping devices 15 and a new flat bar 10 is inserted into the supports 17,18.

Upon pressing the "ON" button 58 the retracting wedge 1 moves from the left to the right and performs the severing of the new flat 11 from the new flat bar 10 in the opposite direction.

Because no manual labour must be performed for the severing of the flats 11 and because the wedge 1 operates in both directions a time and cost saving as well as safe operation of retracting the flats from the flat bars can be performed.

Since many modifications, variations and changes in detail may be made to the described embodiments, it is intended that all matter contained in the foregoing description or shown in the accompanying drawings be interpreted as illustrative and not in a limiting sense and may be otherwise variously embodied and practised within the scope of the following claims.

What is claimed is:

1. An apparatus for retracting flats from the elongated flat bars of a carding machine, said apparatus comprising:

a support means for supporting an elongated flat bar so that its longitudinal axis is supported in a predetermined, fixed position, the flat bar having a flat mounted thereon for removal therefrom;

guide means connected to said support means and having a guideway substantially parallel to and spaced from the longitudinal axis of the supported flat bar;

a retracting wedge mounted on said guide means for bidirectional movement in said guideway substantially parallel to the longitudinal axis of the supported flat bar;

said retracting wedge having a flat bottom surface and first and second separating edges on opposite longitudinal ends thereof, each of said separating edges defined by the intersection at an acute angle of a wedge surface and said bottom surface;

said guide means supporting said retracting wedge so that said opposite ends thereof are aligned along the longitudinal axis of the supported flat bar with said separating edges positioned along a line intermediate the flat to be removed and its associated flat bar; and drive means coupled to said retraction wedge to cause said retraction wedge to move longitudinally in a first direction or a second direction along said guideway to cause said first or second separating edge to enter between the flat to be separated and its flat bar to thereby separate and remove the flat from the flat bar.

2. The apparatus of claim 1, wherein said flat retracting wedge means is mounted to a spindle nut means which spindle nut means is arranged on a motor driven screw spindle means and is guided thereon axially displaceable and nonrotatable.

3. The apparatus of claim 2, wherein said screw spindle means comprises a worm gear with bearing balls.

4. The apparatus of claim 2, wherein said screw spindle means comprises a worm gear.

5. The apparatus of claim 2, wherein said spindle nut means is mounted to a carriage means provided with frictionless bearings, which carriage means is guided at both its sides by and is displaceable along a guide means.

6. The apparatus of claim 1, wherein said retracting wedge means is arranged in a driven feed chain arrangement.

7. The apparatus of claim 1, wherein said supporting means is provided with two bar supporting means arranged at a distance from each other and is provided further with a clamping means.

8. The apparatus claimed in claim 1 wherein said each separating edge further comprises:

first and second knife edges, said first knife edge formed between the intersection of an associated first wedging surface and said bottom surface and said second knife edge formed between the intersection of an associated second wedging surface and said bottom surface, said first and second knife edges formed at an acute angle relative one another.

* * * * *